United States Patent [19]

Muster

[11] Patent Number: 5,031,264

[45] Date of Patent: Jul. 16, 1991

[54] CLEANING SYSTEM FOR SELF OPENING CANS

[76] Inventor: William M. Muster, c/o PCM Works, 658 Quincy Ave., Long Beach, Calif. 90814

[21] Appl. No.: 320,225

[22] Filed: Mar. 6, 1989

[51] Int. Cl.[5] ..... B08B 1/04

[52] U.S. Cl. ..... 15/104.93; 15/246; 15/210 R; 220/906; 220/268

[58] Field of Search ..... 15/246, 104.04, 104.93, 15/210 R; 220/1 BC, 268, 269, 271, 66; 215/228

[56] References Cited

U.S. PATENT DOCUMENTS

| | | | |
|---|---|---|---|
| 1,627,415 | 5/1927 | Schlesinger | 15/210 R |
| 4,077,538 | 3/1978 | Waterbury | 220/268 |
| 4,114,778 | 9/1978 | O'Neal | 220/269 X |
| 4,339,053 | 7/1982 | Tarro | 220/269 |
| 4,609,123 | 9/1986 | Poncy | 220/269 |
| 4,651,890 | 3/1987 | Coker et al. | 220/66 X |

*Primary Examiner*—Frankie L. Stinson

*Attorney, Agent, or Firm*—Natter & Natter

[57] ABSTRACT

A can top cleaning system includes a premoistened pad which is sealed in a packet mounted to the underside of a self opening can pull tab. The packet includes a tear line or a pull strip along its bottom panel for opening the packet and exposing the pad. Once the pad is exposed, rotation of the pull tab effects wiping of the can top by the pad. Alternately, the pad is completely removable from the packet and may be used to manually wipe the can top or may be placed beneath the pull tab for wiping.

17 Claims, 2 Drawing Sheets

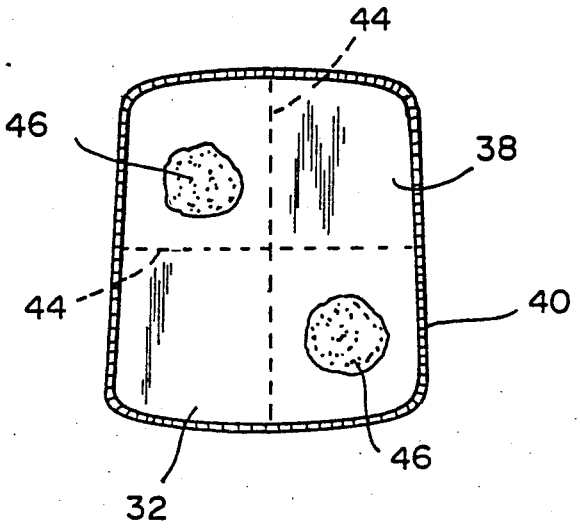
FIG. 3
FIG. 4
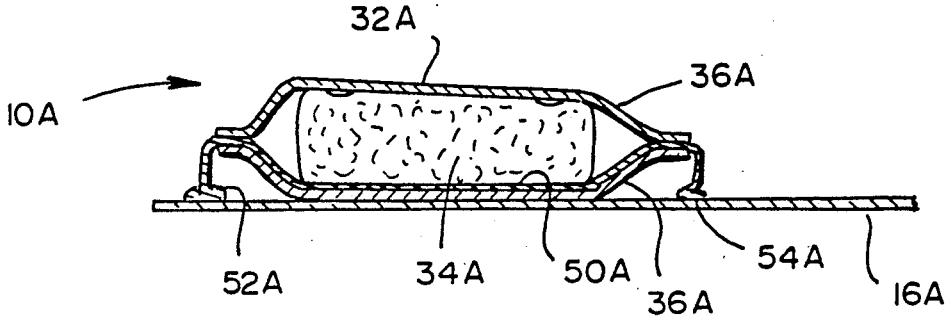
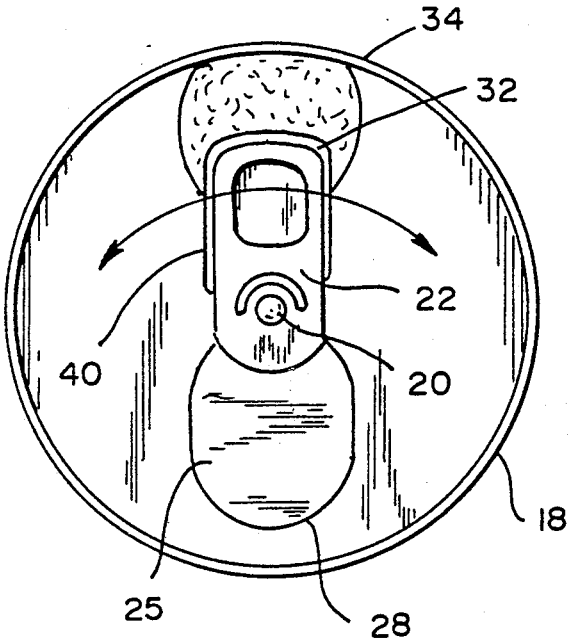
FIG. 5

CLEANING SYSTEM FOR SELF OPENING CANS

BACKGROUND OF THE INVENTION

1. Field of the Invention

This invention relates generally to cans employed for containing foods or beverages and more particularly to systems for cleaning can tops having self opening pull tabs prior to dispensing the contents of a can.

2. Background Art

The food and beverage industry has utilized cans as a packaging medium for generations. Beer and soda have, for many years, been exclusively canned in self opening cans having a top with a weakened aperture area outline and a pull tab lever adapted to engage the weakened area and exert force sufficient to sever the material along the outline.

Innovations in such packaging have heretofore included the permanent mounting of both the pull tabs and the portions of the can top within the aperture outline to reduce litter. This was accomplished by mounting the pull tab such that when pulled it depressed the aperture area into the can and its contents. Similar self opening pull tabs have been employed on canned foods and, in particular, individual portion sizes of canned foods.

Utilization of the self opening can technology has proven cost efficient and has eliminated the necessity of using a can opener, thus making canned foods and beverages readily available for casual consumption to those away from a kitchen or home environment. Unfortunately, when a potential consumer is away from a home environment, the availability of facilities for cleaning the can top was generally lacking. Thus, dirt, dust, contaminants, infectious elements and the like carried on the can top entered the food product contents and became ingested. The need for providing a readily avaiable handy cleaning system for use in wiping a self opening can top prior to opening has been recognized by those who were aware of the medical consenquences of neglecting this simple hygienic expedient.

One approach toward providing a can cleaner was disclosed in U.S. Pat. No. 4,651,890. The invention disclosed therein comprised a cleansing pad sealed within a pouch which, in turn, was carried in the hollow underside of the beverage can. To clean the can top, one was required to turn the can upside down, open the pouch, remove the pad, manually wipe the top of the can and then was expected to return the pad to the pouch to avoid generating unnecessary litter.

Although it is unknown if such invention was ever commercialized, it would appear that many consumers would not employ the pad, possibly because they would not even know of its existence, tucked in beneath the can and out of view. Further, use of the pad would be, to say the least, awkward. To require the reinsertion of the pad into the pouch after use would mean turning the can upside down which normally could not be accomplished until its contents were emptied. By that time, the user probably will have thoughtlessly discarded or have forgotten the pad entirely, thus generating additional litter.

SUMMARY OF THE INVENTION

A premoistened cleansing pad is sealed in a packet which is secured beneath a pull tab lever of a self opening can, such as a beverage can. The pad is exposed by opening the bottom of the packet through a weakened tear line or a strip or tape and the pad expands or is pulled from the packet to contact the can top, including its rim.

By rotating the pull tab while the pad is in contact with the upper surface of the can top, the top is cleansed. Since the pad is preferably anchored to the packet, no additional litter is generated and the can is opened by utilizing the pull tab lever in the conventional manner.

Optionally, the pad may be completely removed from the packet for manual wiping of the top and reinsertion into the packet.

From the foregoing compendium it will be appreciated that it is a consideration of the present invention to provide a cleaning system of the general character described for a self opening can which is not subject to the disadvantages of the background art aforementioned.

A feature of the present invention is to provide a cleaning system of the general character described for a self opening can which alleviates the deficiencies of the background art aforementioned.

An aspect of the present invention is to provide a cleaning system of the general character described for a self opening can which is well adapted to maintain the sanitary condition of a can's contents during removal of such contents.

A further consideration of the present invention is to provide a cleaning system of the general character described for a self opening can which avoids the generation of additional litter.

To provide a cleaning system of the general character described for a self opening can which is low in cost is a further consideration of the present invention.

An additional feature of the present invention is to provide a cleaning system of the general character described for a self opening can which is adapted for economical mass production fabrication.

A further consideration of the present invention is to provide a cleaning system of the general character described for a self opening can which is simple to use.

Another feature of the present invention is to provide a cleaning system of the general character described for a self opening can which prevents a potential consumer of the can's contents from opening the can without consciously determining whether or not the can top is to be cleaned.

Other aspects, features and considerations of the present invention in part will be obvious and in part will be pointed out hereinafter.

With these ends in view, the invention finds embodiment in certain combinations of elements and arrangements of parts by which the said aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which is shown some of the various possible, exemplary embodiments of the invention.

FIG. 3 is a bottom plan view of the packet and showing preformed frangible tear lines in a bottom panel of the packet and adhesive for mounting the bottom panel to the top of the can;

FIG. 4 is a fragmentary sectional view through the packet and the top of the can, similar to FIG. 2, with portions, including the pull tab, delete for clarity and showing an alternate embodiment wherein a tear strip is provided for opening the bottom panel of the packet and;

FIG. 5 is a plan view of the can with the packet opened and illustrating the manner in which the pull tab is rotated for cleansing the can top.

DESCRIPTION OF THE PREFERRED EMBODIMENTS

Figure 1:
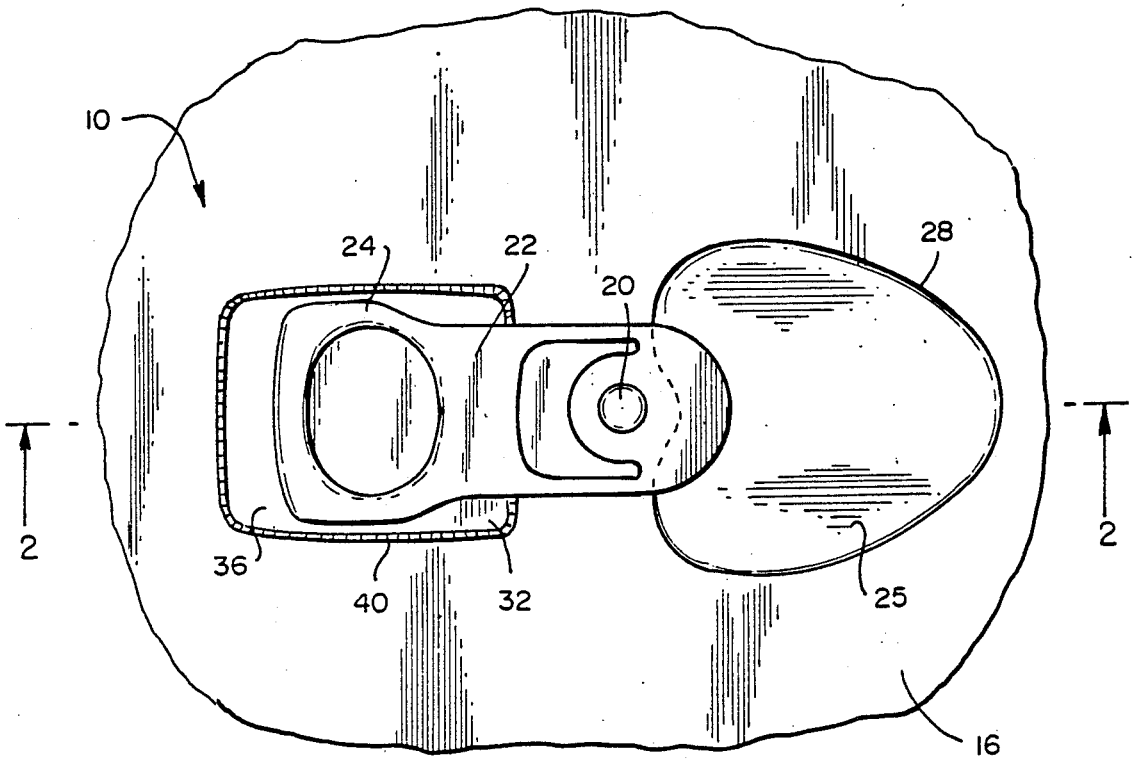
FIG. 1 is an enlarged scale fragmentary top plan view of a self opening can showing a pull tab and a cleaning system constructed in accordance with and embodying the invention.

Referring now in detail to the drawings, the reference numeral 10 denotes generally a cleansing system for a can top constructed in accordance with and embodying the invention. The cleansing system is configured for use in conjunction with a self opening can, such as a beverage can 12. The can 12 includes a cylindrical side wall 14 and a substantially planar top 16. By way of example, the top 16 is constructed as a conventional beverage can top and includes an annular rim 18, the upper edge of which is rolled over the side wall 14 to seal the can. The can top 16 also includes a unitary rivet 20 which serves to pivotally mount a conventional self opening pull tab 22.

Figure 2:
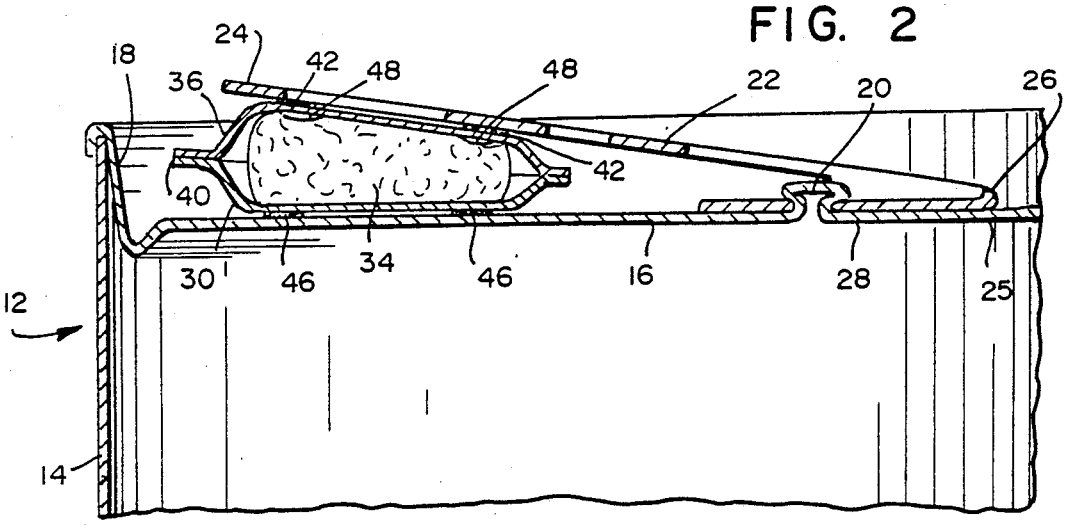
FIG. 2 is a fragmentary sectional view through the can, the same being taken substantially along the plane 2—2 of FIG. 1 and showing a premoistened pad carried in a packet which is secured to both the underside of the pull tab and the top of the can.

The pull tab 22 includes a finger grip 24 for lifting the tab. When lifted by the finger grip 24, the tab 22 pivots about the rivet 20, in a clockwise direction, as viewed from FIG. 2. As the tab pivots, its distal end 26, opposite the finger grip 24, is urged downwardly against an aperture area 25 in the upper surface of the top 16. The aperture area 25 is defined by a line 28 of thinned cross section or otherwise weakened area of the top 16. Depression of the aperture area 25 by the end 26 of the pull tab causes the can top to fracture along the line 28, forcing the aperture area 25 into the contents of the can.

Pursuant to the present invention, the cleansing system 10 includes a sealed, moisture impervious packet 32 which carries a premoistened pad 34. The packet 32 comprises a top panel 36 and a bottom panel 38, conventionally joined along a sealed peripheral seam 40.

The top panel 36 is preferably permanently joined to the underside of the pull tab 22 by a layer or deposit of adhesive 42. The bottom panel 38 is configured to be easily split or torn open for the purpose of exposing the pad 34. For this purpose, the bottom panel, as illustrated in FIG. 3, may include one or more frangible tear lines 44.

In order to provide for automatic self opening of the packet 32 by partial lifting or rotation of the pull tab 22, portions of the bottom panel 38 are joined to the top 16 by adhesive deposits 46. Thus, when the pull tab 22 is slightly lifted, the adhesive 46, holding only portions of the bottom panel 38, causes sufficient stress to be applied to the frangable lines 44 to tear the bottom panel 38, causing the panel to open and expose the pad 34 to the top 16.

In accordance with the invention, the pad 34 may be of a larger size than the interior dimensions of the packet 32 and will thus expand or bloom radially outward towards the rim 18. Alternately, the pad may be pulled gently outwardly from the packet until it contacts the rim 18 as illustrated in FIG. 5.

Thereafter, rotation of the pull tab in a clockwise or counterclockwise direction, as illustrated in FIG. 5, at least 180 degrees about the rivet 20, will effect a cleansing of the can top 16 in the aperture area and at the rim 18 adjacent the aperture area 25. Such rotation may be accomplished by inserting one's finger tip into the finger grip opening of the pull tab 22.

In order to reduce the generation of excess litter, portions of the pad 34 are preferably anchored to the interior of the packet 32 by suitable means, such as an adhesive 48. Alternately, the pad 34 may be completely removable from the packet 32 and may be grasped by the user for manually wiping the top 16, including the aperture area 25. Prior to disposing of the can, the user may then reinsert the pad into the packet.

Referring now to FIG. 4, wherein an alternate embodiment of the invention is shown, like numbers have been employed to denote like components as the previous embodiment, however, bearing the suffix "A". In the alternate embodiment, a can top cleansing system 10A is shown to include a packet 32A mounted to the underside of a pull tab which, in turn, is mounted to a top 16A, in a manner substantially identical to that disclosed with respect to the previous embodiment.

The alternate embodiment, however, employs alternate mechanisms for opening a bottom panel 38A of the packet 32A to expose a pad 34A. A tear strip 50A is positioned within the packet 32A and extends along t[e interior face of the bottom panel 38A. The tear strip 50A extends through a peripheral seam 40A of the packet and, in an automatic opening mode, will be anchored to the top 16A by an adhesive mass 52A. When the pull tab is lifted or rotated, movement of the packet relative to the end of the tear strip 50A which is anchored to the top 16A will cause the tear strip 50A to tear through the bottom panel 38A, exposing the pad 34A.

Alternately, a free end 54A of the tear strip 50A may be accessible for manual grasping and pulling to open the packet 32A along the bottom panel 38A.

In either embodiment, the premoistened pad carried in the packet may be of any conventional configuration and may be formed of non-woven fiberous or cellular sponge material. Suitable conventional cleansing agents in a liquid carrier may be impregnated in the pad. If desired, disinfectants or sanitizing agents such as alcohol and the like may also be impregnated in the pad.

Thus it will be seen that there is provided a can top cleansing system which achieves the various aspects, features and considerations of the present invention and which is well adapted to meet the conditions of practical usage.

As various possible embodiments might be made of the present invention, and as various changes might be made in the embodiments set forth above, it is to be understood that all matter herein described or shown in the accompanying drawings is to be interpreted as illustrative and not in a limiting sense.

Having thus described the invention there is claimed as new and desired to be secured by Letters Patent:

1. A system for cleaning a top of a can prior to opening, the can including a tab for opening the top, the system including cleansing means for wiping the top to remove contaminants therefrom and means for mounting the cleansing means to pull tab whereby the cleansing means is readily available for wiping the top prior to opening the can to prevent contaminants from entering the can.

2. A system for cleaning a top of a can prior to opening as constructed in accordance with claim 1 wherein the means for mounting the cleansing means to the pull tab includes means for mounting the cleaning means to the underside of the pull tab.

3. A system for cleansing a top of a can prior to opening as constructed in accordance with claim 1 wherein the means for mounting the cleansing means to the pull tab comprises adhesive.

4. A system for cleansing a top of a can prior to opening, the can including a pull tab for opening the top, the system including cleansing means for wiping the top to remove contaminants therefrom and means for mounting the cleansing means to the pull tab whereby the cleansing means is readily available for wiping the top prior to opening the can to prevent contaminants from entering the can, the means for wiping the top comprising a pad and the means for mounting the cleansing means to the pull tab including a packet, the pad being carried in the packet, the means for mounting further including means for mounting the packet to the pull tab.

5. A system for cleansing a top of a can prior to opening as constructed in accordance with claim 4 wherein the pad is premoistened and the packet comprises a sealed packet, whereby pad moisture is retained.

6. A system for cleansing a top of a can prior to opening as constructed in accordance with claim 4 further including means permanently securing the pad to the packet whereby litter is reduced.

7. A system for cleansing a top of a can prior to opening as constructed in accordance with claim 4 wherein the pad is in a compressed state within the packet, the pad being expandable upon opening the packet for contacting the top of the can.

8. A system for cleansing a top of a can prior to opening as constructed in accordance with claim 4 further including means for automatically opening the packet in conjunction with movement of the pull tab.

9. A system for cleansing a top of a can prior to opening as constructed in accordance with claim 8 wherein the means for automatically opening the packet comprises frangible tear lines formed on the packet and means restraining a portion of the packet against movement relative to the pull tab.

10. A system for cleansing a top of a can prior to opening as constructed in accordance with claim 8 wherein the means for automatically opening the packet comprises a tear strip and means restraining an end of the tear strip against movement relative to the pull tab.

11. A system for cleansing a top of a can prior to opening, the can including a pull tab for opening the top, the system including cleansing means for wiping the top to remove contaminants therefrom, the means for wiping the top comprising a pad and means for mounting the pad to the pull tab, whereby the pad is readily available for wiping the top prior to opening the can to prevent contaminants from entering the can.

12. A method of cleaning a top of a can having a self opening pull tab and a system for cleaning the top of the can prior to opening as constructed in accordance with claim 11, the method comprising the steps of:

(a) positioning the pad in contact with the top of the can and between the pull tab and the top of the can and (b) wiping the top of the can by rotating the pull tab.

13. A method of cleaning a can top in accordance with claim 12 wherein the pull tab is rotated by placing a finger in a finger grip of the pull tab and rotating the finger.

14. A method of cleaning a can top in accordance with claim 12 wherein the pad is carried in a packet having a top panel and a bottom panel, the method including the steps of:

(c) opening the bottom panel of the packet to position the pad in contact with the top of the can.

15. A method of cleaning a top of a self opening can as constructed in accordance with claim 14 wherein the step of opening the panel includes the steps of anchoring a portion of the packet against movement relative to the pull tab, securing a further portion of the packet to the pull tab and moving the pull tab.

16. A method of cleaning a top of a self opening can in accordance with claim 14 wherein the packet includes a tear strip, the step of opening the bottom panel of the packet including the step of anchoring a portion of the tear strip against movement relative to the pull tab, securing a portion of the packet to the pull tab and moving the pull tab, whereby the tear strip opens the packet.

17. A system for cleaning a top of a can prior to opening, the can including a self opening pull tab, an aperture area of the top being pushed inside the can during said opening, the system including cleansing means for wiping the aperture area and means for mounting the cleansing means to the pull tab whereby the aperture area of the top does not contaminate contents of the can when the can is opened.

* * * * *